United States Patent [19]

Jones, III

[11] Patent Number: 4,700,159

[45] Date of Patent: Oct. 13, 1987

[54] SUPPORT STRUCTURE FOR COAXIAL TRANSMISSION LINE USING SPACED DIELECTRIC BALLS

[75] Inventor: Earl M. Jones, III, Union Bridge, Md.

[73] Assignee: Weinschel Engineering Co., Inc., Gaithersburg, Md.

[21] Appl. No.: 717,719

[22] Filed: Mar. 29, 1985

[51] Int. Cl.[4] ..... H01P 3/06

[52] U.S. Cl. ..... 333/244; 333/260; 174/28

[58] Field of Search ..... 333/244, 243, 260; 174/28

[56] References Cited

U.S. PATENT DOCUMENTS

| | | | |
|---|---|---|---|
| 2,018,353 | 10/1935 | Crothe | 174/28 |
| 2,403,252 | 7/1946 | Wheeler | 333/33 |
| 2,740,826 | 4/1956 | Bondon | 333/243 X |
| 2,754,349 | 7/1956 | Werner | 174/28 |
| 2,922,127 | 1/1960 | Dench | 333/34 |
| 3,055,967 | 9/1962 | Bondon | 174/28 |
| 3,151,925 | 10/1964 | Bondon | 333/244 |
| 3,323,083 | 5/1967 | Ziegler, Jr. | 333/260 |
| 3,437,960 | 4/1969 | Ziegler, Jr. | 333/260 |
| 3,542,938 | 11/1970 | Graneau | 174/28 |
| 3,751,802 | 8/1973 | Holm et al. | 29/600 |
| 4,297,662 | 10/1981 | Gross et al. | 333/252 |
| 4,431,255 | 2/1984 | Banning | 339/177 E |

FOREIGN PATENT DOCUMENTS

| | | | |
|---|---|---|---|
| 368195 | of 0000 | France | 174/28 |

OTHER PUBLICATIONS

Wholey, W. Bruce, et al; "A New Type of Slotted Line Section"; *Hewlett Packard Publication;* U.S. Pat. Off., Nov. 7, 1949.

*Primary Examiner*—Eugene R. LaRoche
*Assistant Examiner*—Benny T. Lee
*Attorney, Agent, or Firm*—Hall, Myers & Rose

[57] ABSTRACT

A support structure for a coaxial transmission line includes a plurality of groups of dielectric balls compressibly mounted between the inner and outer conductors of the coaxial transmission line, the balls being "locked" into position via recesses located in the outer face of the inner conductor with holes centrally located in the balls and aligned parallel with the longitudinal axis of the transmission line sewing to compression relieve the balls and improve the VSWR of the transmission line, and with seventy-degree V-grooves being located on either side of the recesses in longitudinal alignment with the coaxial transmission line, for further improving the VSWR by adding inductance to compensate for the capacitance added by the presence of the balls.

22 Claims, 17 Drawing Figures

E-E

SUPPORT STRUCTURE FOR COAXIAL TRANSMISSION LINE USING SPACED DIELECTRIC BALLS

BACKGROUND OF THE INVENTION

1. Field of the Invention

The field of the present invention relates generally to coaxial transmission lines, and more particularly to support structures for such transmission lines.

2. Discussion of the Relevant Art

The need for a support structure for coaxial transmission lines has been recognized previously in the art. Generally, the presently known support mechanisms will introduce discontinuities or changes in the characteristic impedance of the transmission line. Further, it is commonly known that a transmission line may incorporate a probe for measuring the incident voltage with the reflected signal. To assure proper function this device must be provided with a well defined characteristic impedance, and support means for centrally locating the inner conductor of the coaxial line.

In Banning, U.S. Pat. No. 4,019,162, a coaxial transmission line for ultra high frequency (u.h.f.) waves is shown for use with slotted line equipment, in which transmission line the center conductor is supported coaxially within the surrounding outer conductor by spaced apart dielectric pins extending radially between the conductors, wherein wave reflections are minimized through the application of shallow depressions in the outer surface of the inner conductor about the pins, with the depressions completely surrounding the point of engagement of each pin with the inner conductor, and the depressions being dimensioned to produce an inductive effect for compensating the capacitive effect of the dielectric pins. Banning also discusses the use of holes drilled in the inner conductor, or of circumferential grooves spaced longitudinally ahead of and/or behind the pins being used for providing a support mechanism. Also, the use of beads instead of dielectric pins is discussed, but no teaching is made as to how such beads might be incorporated for providing a support means. The present inventor recognizes that the use of dielectric pins for supporting an inner conductor within an outer conductor of a coaxial transmission line tends to limit the size of the transmission line. Reducing the size of the transmission line while providing for easy assembly tends to preclude the use of such pins. Also, the pins are oftentimes glass reinforced, and as a result tend to become extremely brittle, further complicating the assembly and size reduction problems.

Another Banning patent, U.S. Pat. No. 4,431,255, discloses a coaxial connector having a first dielectric member located in the annular space between the center conductor and outer shell, and a second dielectric member press fit into the shell to surround but not contact the center conductor in the mating region, whereby the second dielectric member provides support to the center conductor during mating of the connector, for providing a desired impedance for use of the connector with coaxial transmission lines at frequencies beyond 26.5 GHz. A simpler method of coupling and supporting the ends of a coaxial transmission line is disclosed in Dench, U.S. Pat. No. 2,922,127, wherein a seal for a coaxial line is taught that includes a ceramic cup for receiving an inner or centrally located conductor of the transmission line and sealing off the same for providing vacuum sealing between the coaxial line and a wave guide.

Ziegler, U.S. Pat. No. 3,437,960, discloses dowel-like dielectric beads for use in high-frequency coaxial connectors, whereby one dielectric bead structure (104) is shown for supporting and sealing the inner conductor of a coaxial line centrally within the outer conductor of the coaxial line near the ends of the line. Ziegler further teaches the use of a spiral bead in a helix-like manner about the length of the inner conductor for providing support for maintaining the inner conductor centrally located within the outer conductor. Another Ziegler patent, U.S. Pat. No. 3,323,083, teaches the use of dowel-like dielectric beads in a coaxial transmission line connector for maintaining an inner conductor centrally located within an outer conductor, whereby the dielectric bead is dimensioned for obtaining a desired impedance.

Bondon, U.S. Pat. No. 3,055,967, shows the use in a coaxial cable of notched insulating tubes arranged in a tightly packed array between the inner and outer conductors of the coaxial cable for maintaining the central positioning of the inner or center conductor. The elongated tubes may be circular or somewhat triangular in shape, and are shown to include radially oriented notches for improving the impedance and loss characteristics of the coaxial cable.

Wheeler, U.S. Pat. No. 2,403,252, teaches the use in a high-frequency matching device of an insulating disk for supporting one end of a centrally located conductor within an outer conductor via use of a pin centrally located in the disk and protruding into the centermost portion of the inner conductor.

The various known arrangements for providing a coaxial transmission line and coaxial transmission line connectors do not permit easy fabrication of relatively small slotted coaxial transmission lines. The use of glass reinforced pins for providing support and spacing means between the inner and outer conductors of a coaxial transmission line tend to cause increasingly difficult assembly problems as the coaxial transmission size is reduced, and are subject to pin breakage because of the brittleness of the material generally used. Also, known techniques of terminating a coaxial transmission line, and for providing coaxial transmission line connectors cause relatively complicated assembly problems, and are difficult to miniaturize.

An object of the present invention is to provide a support structure for a coaxial transmission line that permits easy assembly and size reduction of the line.

Another object of the invention is to provide an improved connector for mating to a coaxial transmission line of reduced size.

SUMMARY OF THE INVENTION

The present invention provides a coaxial transmission line of reduced size via the use of a plurality of groups of dielectric balls compressibly located between the inner and outer conductors of the transmission line for supporting the inner conductor at a central location within the line, whereby the balls are "locked" into predetermined positions above the outside surface of the inner conductor via recesses located at those positions in the outer face of the inner conductor, and V-grooves longitudinally aligned with the longitudinal axis of the transmission lines are located on either side of the recesses for improving the standing wave ratio of the transmission line compensating for the capacitive reactance added by the dielectric balls. The inner conductor has its ends secured into male or female pins of male and/or female connector means, respectively, located at either end of the coaxial transmission line.

BRIEF DESCRIPTION OF THE DRAWINGS

The invention will be described with reference to the drawings, wherein like items are indicated by the same reference number.

DESCRIPTION OF THE PREFERRED EMBODIMENTS

Figure 1:
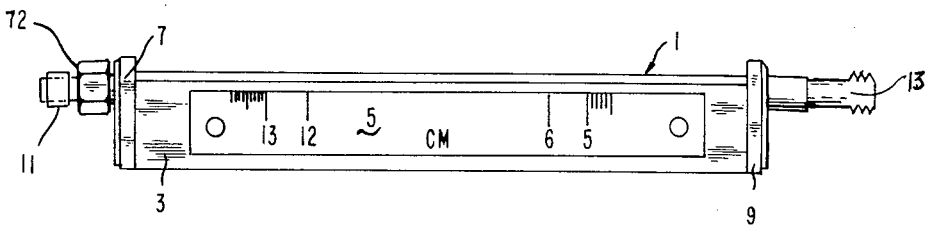
FIG. 1 shows a slotted coaxial transmission line incorporating the present invention.

With reference to FIG. 1, a slotted coaxial transmission line member 1 is mounted upon a frame 3 including a ruled scale 5, a left-hand bracket 7, and a right-hand bracket 9 between which the slotted coaxial transmission line 1 is mounted. Also shown is a female generator connector 11, and a female measuring connector 13. Note that in this example the radio frequency (RF) connectors used are SMA compatible (Military Standard MIL-C-39012). In typical operation, the slotted transmission line 1 is connected between a microwave generator and a load of unknown impedance. A probe (not shown) is moved up and down a longitudinal slot in the top of the coaxial transmission line 1 (the slot is not shown), while an operator observes readings on an associated meter of an instrument. When a nulling point is reached, the position of the probe is observed by noting the position of a pointer attached to the probe and moveable with the probe about the scale 5. The reading on the scale at a nulling point can be transformed into the impedance of the load. This invention's use with a slotted coaxial line is given for purposes of illustration only, whereby the invention has much broader usage than the typical example given.

Figure 2A:
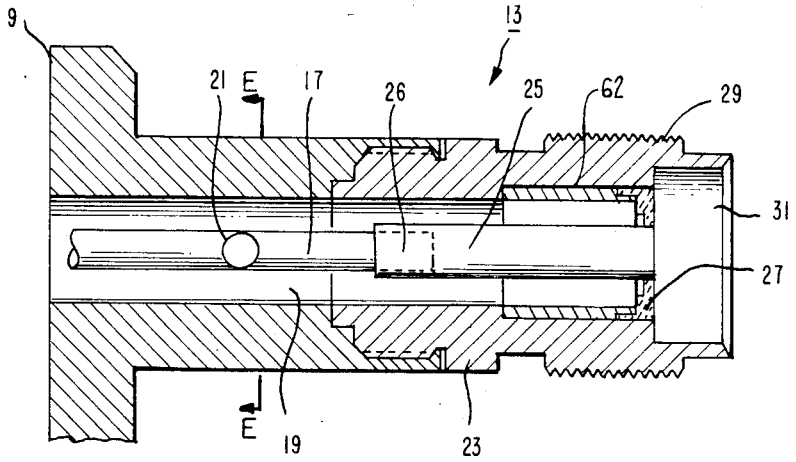
FIGS. 2A and 2B illustrate cross-sectional detailed views of a typical connectors of one embodiment of the invention.
Figure 3:
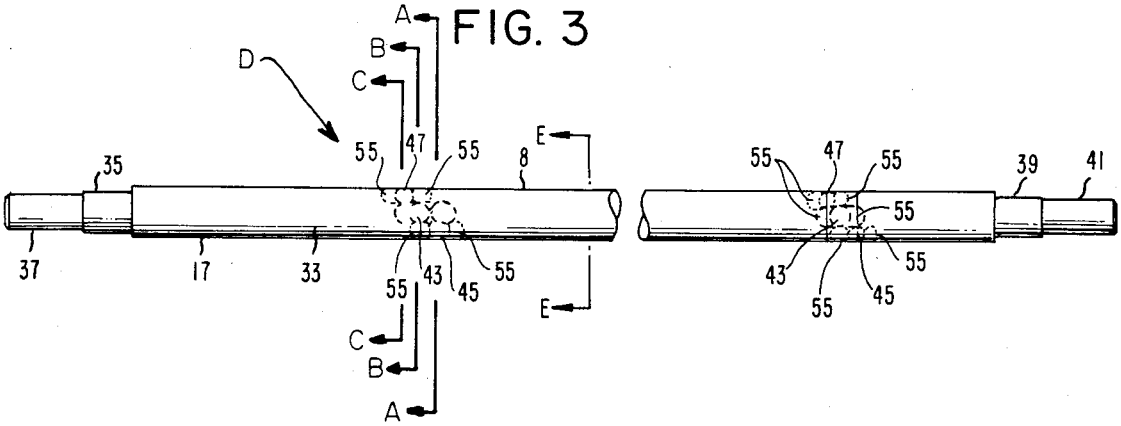
FIG. 3 is a detail view of the inner conductor incorporating various embodiments of the invention.
Figure 2B:
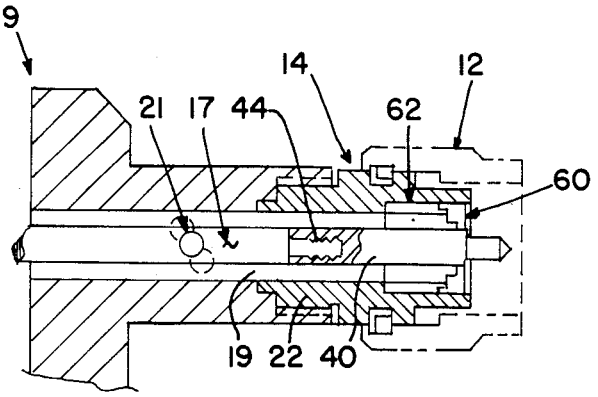

A detailed cross-sectional view of the connector 13 is shown in FIG. 2. As shown, the bracket or support 9 encloses an inner conductor 17 within a cylindrical area 19. The inner conductor 17 is supported within the cylindrical or coaxial cavity 19 via a group of dielectric balls 21 (Teflon or Rexolite) compressibly held in place around the outer suface of the inner conductor 17. The dielectric balls are located between the inside surface of the cavity 19 and the outer surface of the inner conductor 17, and dimensioned to insure that the inner conductor is centrally located within the cavity 19. The connector shell or outer housing 23 has step-like reduced flanges at its inside end for rigid connection to step-up flanges of the support 9, as shown, to establish good inside diameter alignment. An electrically conductive pin 25 (female in this example) is rigidly connected to the inner conductor 17 as shown. The pin 25 is attached to inner conductor 17 by a use of threads on the end of conductor 17 screwing into a threaded hole centrally located within the interior end of pin 25. The dielectric shell 60 is injection molded onto conductive ring 62 then located within shell 23 for electrically isolating and centrally retaining contact pin 25. The front portion of the connector assembly 13 is configured to provide a female connector. By simple modification, the plug 25 can be extended and the front portion of the connector 13 modified to appear as the front portion of the male connector 14 (see FIG. 2B", for providing a male connector. Threads 29 (FIG. 2A) provided for permitting threadable coupling to a nut of a mating male connector, in this example. A recessed area 31 receives the central conductor of the mating connector for permitting electrical connection with the pin 25. Feed connector assembly 11 is threaded to inner conductor 17, then threaded with coupling nut 72. The inner conductor 17 is shown in FIG. 3. In this example the material used for the inner conductor 17 is molybdenum, and has a surface finish of less than 16 microinch RMS. The choice of molybdenum was made to provide strength and rigidity to inner conductor 17 to prevent its sagging. Testing of waveguide surface finish effects on losses at 35 GHz have been conducted by Frederick J. Tischer as described in his paper entitled "Surface Characteristics of Metals and Waveguide Attenuation at Millimeter-wave Frequencies Between 25 and 180 GHz." 8th European Microwave Conference Proceedings, Paris, France, Sept. 4–8, 1978, pp. 524–527. The article demonstrates that at 35 GHz the surface finish of copper waveguide can seriously increase losses. Changing the surface finish from 4 to 32 microinch RMS can increase losses by 35%, and from 4 to 16 microinch RMS, the change would be only 15%.

Figure 4:
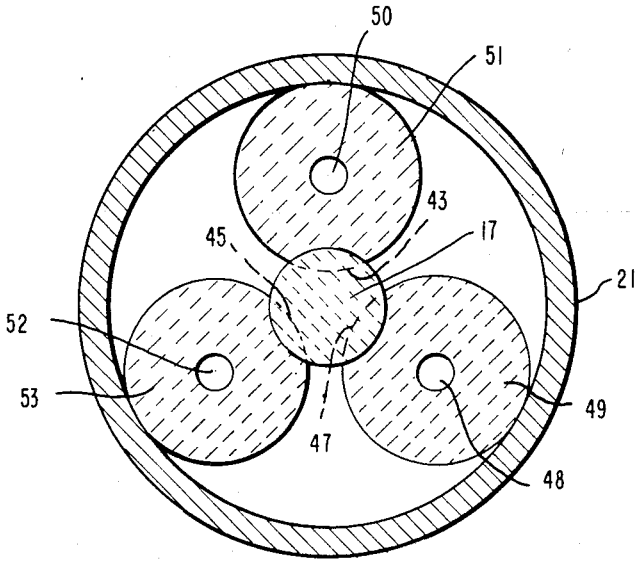
FIG. 4 is a sectional view taken along E—E of FIG. 3.
Figure 5:
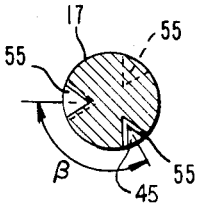
FIG. 5 is a section view taken along A—A of FIG. 3.
Figure 6:
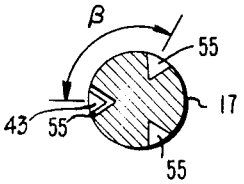
FIG. 6 is a cross-sectional view taken along B—B of FIG. 3.
Figure 7:
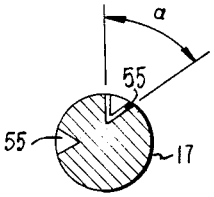
FIG. 7 is a cross-sectional view taken along C—C of FIG. 3.
Figure 8:
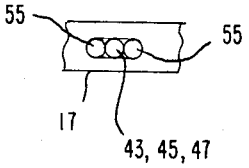
FIG. 8 is a detail view taken about Region D of FIG. 3.

As explained in this article, a good surface finish is required for both inner conductor 17 and cylindrical cavity 19. The main portion 33 of the inner conductor 17 has a length H of about 6.106 inches, and an outside diameter of 0.05 inch, for example. The ends of the inner conductor, illustrated in FIG. 3, 35 and 37 at the left end, and 39 and 41 at the right end, are reduced in outside diameter from the outside diameter of the largest outer diameter portion 33. The very end portions 37 and 41 are in one embodiment threaded for connection to end terminations (25 or 40 see FIGS. 2A and 2B or 65 see FIG. 14). The end portions 35 and 39 are typically 0.037 inch in outside diameter and 0.05 inch long, and the threaded end portions 37 and 41 are typically 0.034 inch in outside diameter and 0.08 inch long. Accordingly, the overall length of the inner conductor 17 is about 6.366 inches, in this example. However, in general it should be noted that the main requirement for the length of the present transmission line is to obtain the lowest possible operating frequency (2 GHz in this example). Also, conical like recesses or holes 43, 45, 47 each having a diameter of about 0.025 inch are radially arranged 120 degrees apart from one another around the outer surface of the central portion 33 of the inner conductor 17. As shown, these holes or recesses 43, 45, 47 are in this example 0.025 inch in diameter and longitudinally displaced from one another by about 0.015 inch between successive ones of the recesses 43, 45, 47, in this example. As will be described in greater detail, these recesses 43, 45, 47 serve to provide "seats" for locking in place about the outer surface of the inner conductor 17 groups of spaced apart dielectric balls 49, 51, 53, compressibly located about the inner conductor 17 as shown in FIG. 4. For the cross-sectional view E—E of FIG. 2, in this example, the dielectric balls 49, 51, and 53 are arranged in groups of three, wherein each may include a hole 48, 50, and 52, respectively, centrally located and completely through each dielectric ball 49, 51, 53 for allowing compression of the material of the dielectric balls 49, 51, 53, respectively, and for minimizing the voltage standing wave ratio of (VSWR or more commonly SWR) the coaxial line. The balls 49, 51, 53 are oriented to insure that the longitudinal axis of their respective holes, 48, 50, 52, are in parallel with the longitudinal axis of the inner conductor 17, for improved performance. In order to further improve the SWR, V-grooves 55 are provided on either side of each one of the recesses 43, 45, 47. The V-grooves 55 are in this example located with their centers about 0.015 inch from the center of the associated one of the recesses 43, 45, 47. The trough of the V-grooves 55 are in this example aligned or in parallel with the longitudinal axis of the inner conductor 17. FIGS. 5 through 7 show cross-sectional views A—A, B—B, C—C for the location of the V-grooves 43, 45, 47 and 55. Note that in this example the V-grooves 55 are equally spaced radially about the outer surface of the inner conductor 17 by an angle beta ($\beta$). In this example, beta ($\beta$) is equal to 120 degrees. In FIG. 8, a detailed view of one of the recesses 43, 45, or 47, in association with V-grooves 55, is shown. Typically, the V-grooves 55 are contiguous with their associated recess 43, 45, 47, respectively. In this example the width of the V-grooves is about 0.02 inch, and the diameter of the recess 43, 45, 47, is about 0.025 inch. The overall length between one associated V-groove 55 to the end of the other associated V-groove 55 is about 0.055 inch, with the distance between the center of a V-groove relative to the longitudinal direction to the center of an associated recess 43, 45, 47, being about 0.015 inch, as previously mentioned. The depth of each of the recesses 43, 45, 47, in this example, is typically 0.017 inch, whereas the depth of the V-grooves 55 is typically 0.013 inch. It should be noted that the depth width and length of the V-grooves 55 is considered critical to estalishing an acceptable SWR for the coaxial transmission line 1. Also note that the V-grooves 55 were in this example fabricated through the use of an engraving tool. The angle of the V-grooves alpha ($\alpha$) is considered critical, and as shown in FIG. 7, is about 70 degrees. The conical recesses or holes 43, 45, and 47 were drilled into the outer surface of the inner conductor 17, for example. These receses 43, 45, 47 could also each be provided by another V-groove, for example.

Figure 14:
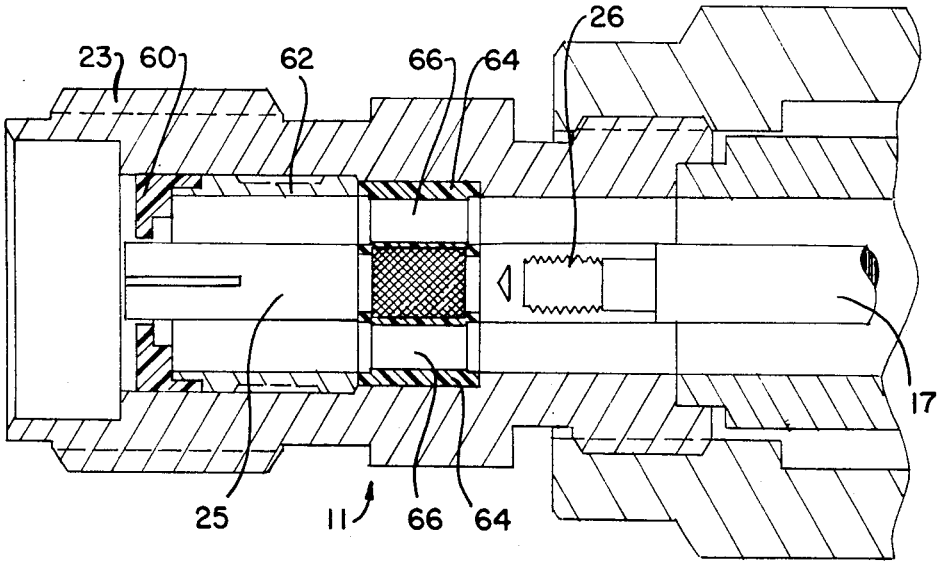
FIG. 14 is a cross-sectional view of a further exemplary embodiment of a connector of the present invention.
Figure 9:
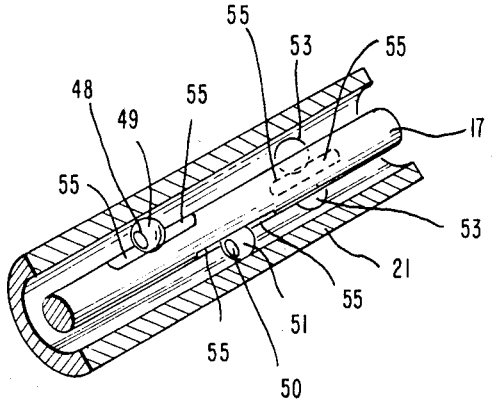
FIG. 9 is a pictorial cutaway view showing one embodiment of the invention.
Figure 10A:
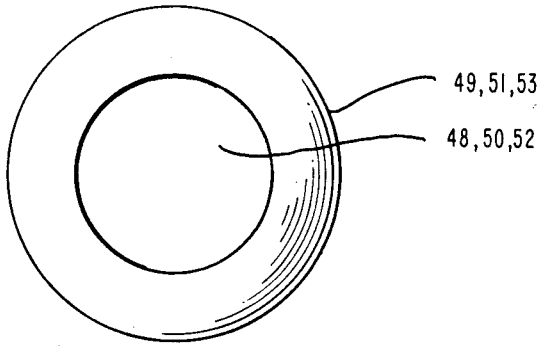
FIGS. 10A and 10B show top and side views, respectively, of dielectric balls of the present invention.
Figure 10B:
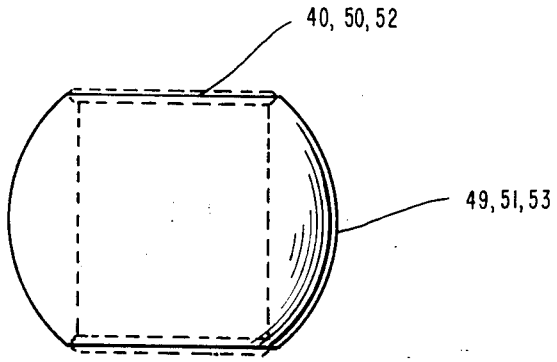
Figure 11:
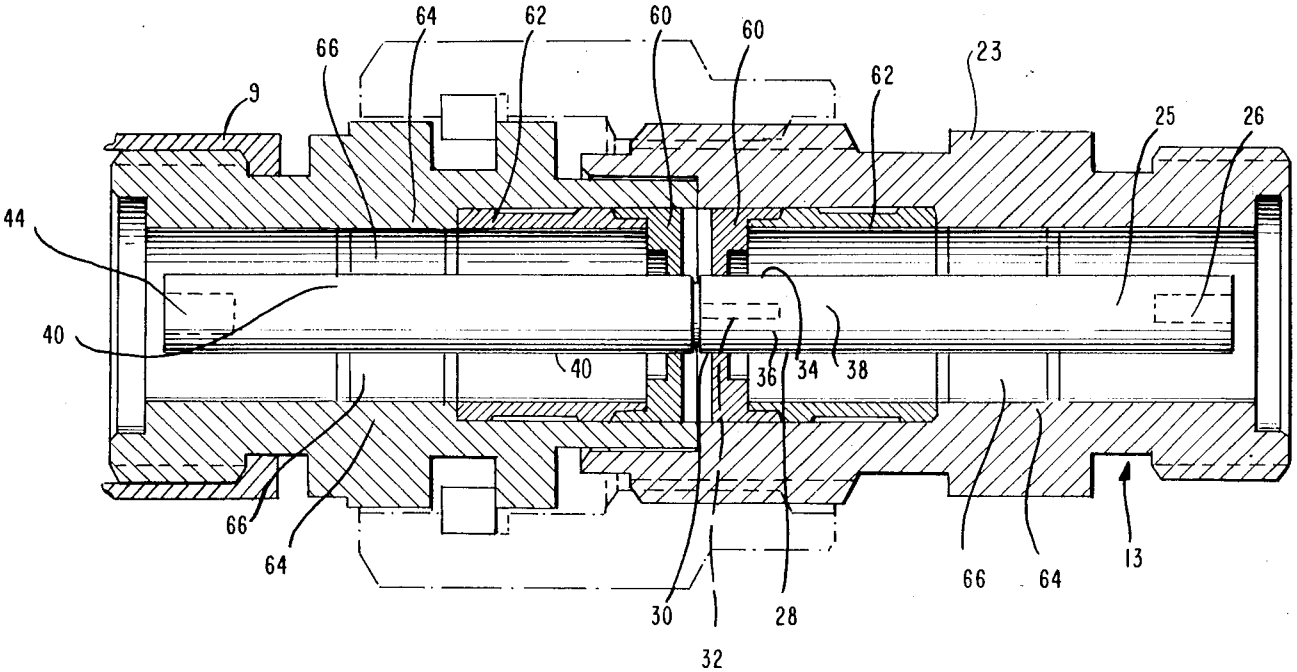
FIG. 11 is a cross-sectional view of mated male and female connectors of one embodiment of the invention.

In FIG. 9, a pictorial view of the interior of the present coaxial transmission line is shown. The dielectric balls 49, 51 and 53, of one group of such balls are shown displaced from one another to a much greater degree than is typical in practice, as can be ascertained from FIG. 3. Note the placement of the V-grooves 55 and the three point support provided by each group of the dielectric balls 49, 51, 53. Teflon or Rexolite material is suitable for use in fabricating the dielectric balls, for example. In one experiment with the inventive support structure, Rexolite balls of about 0.0425 inch diameter with 0.022 inch holes drilled through each ball were utilized (See FIGS. 10A and 10B). Each one of the dielectric balls 49, 51, 53 were placed under 0.005 inch compression when assembled, in this example. Holes 48, 50 and 52 drilled through dielectric 49, 51, 53, respectively, assist in compressability of the dielectric but, more importantly, reduce the capacitive effect of the dielectric by more than 50%, thus reducing the size of the V-grooves or inductance required to obtain optimum SWR. In FIG. 11, a cross-sectoional view of the female connector 13 of FIG. 2 is shown mated to a typical male lead connector, the latter also being shown in cross-section. With regard to the female connector 13, with reference to the initial description given for FIG. 2, note that the female pin 25, in addition to a threaded hole 26 at one end for receiving an end of inner conductor 17, also includes at its other end 28 a centrally located hole 30, and a longitudinal slotway 32, for forming three spring-like fingers for electrically conducting to the front portion of a male load inner connector, as shown. Note also that female connector 13 of FIGS. 2A and 11, female connector 11 of FIG. 14, and male connector 14 of FIG. 2B include a dielectric 13 includes a dielectric disc 60 injection molded onto a conductive shell 62, with the latter two being press fitted into connector shell 23 or 22 respectively to surround but not contact conductor pin 25 or 40 in the mating region. Connector 11 of FIG. 14 also includes a dielectric ring 64 having six holes 66 equally spaced about and through the dielectric ring 64. Male pin 40 of FIG. 2B has threaded hole 44 configured for receipt of the end of conductor 17, female pin 25 of FIGS. 2A, 11 and 14 has threaded hole 26 configured for receipt of the end of conductor 17. The male connector assembly 14 of FIG. 2A, also includes a threaded hole 44 at one end for receiving an end of center conductor 17. In FIG. 14, a female generator connector also includes a dielectric disc 60 and conductive shell 62 identical to those of connector 13 or 14 along with a threaded hole 67 for receiving an end of center 17. Note also that female connector 11 includes a dielectric ring 64 having six holes equally spaced about and through the dielectric ring 64. Further noted that the threaded holes 26 and 44, of female and male connectors assemblies 11 or 13 and 14, respectively, are each adapted for receiving either of the threaded ends 37 and 41 of inner conductor 17 (see FIG. 3). Accordingly, any combination of connectors 11 or 13 and 14, or like connectors of one or the other, can be used to terminate the ends 37, 35, and 39, 41 of inner conductor 17, depending upon the particular application of the transmission line 1. The connectors 11 or 13 and 14, provide both end support for inner conductor 17, and a desired impedance match for operation of coaxial transmission line 1 at frequencies beyond 40 GHz. Assembly of the dielectric balls 49, 51, 53 into the coaxial transmission line assembly, will now be described, with reference to FIGS. 12 and 13.

Figure 12:
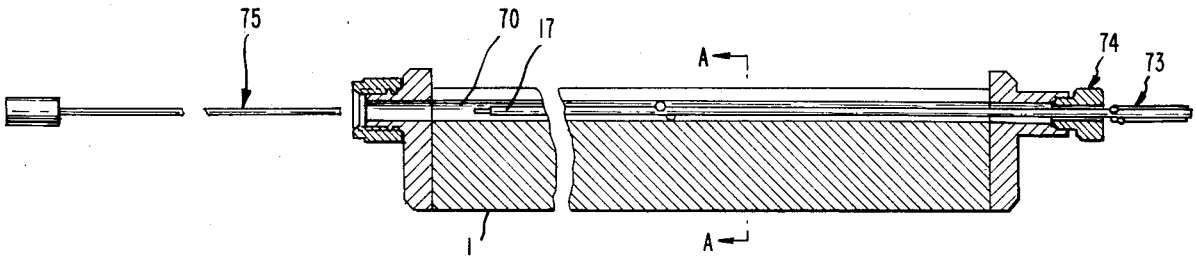
FIGS. 12, 13, and 13A show an apparatus used for the assembling an inner conductor into a cavity of one embodiment of the transmission line of the present invention.
Figure 13:
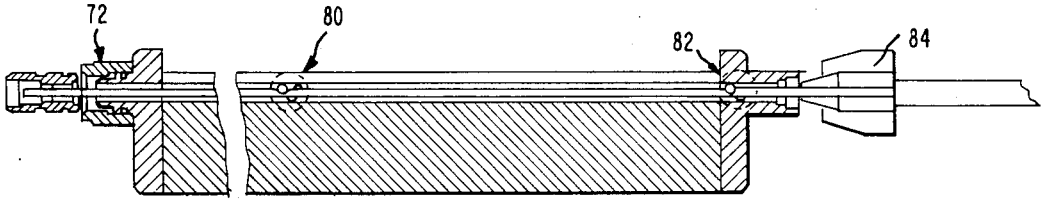
Figure 13A:
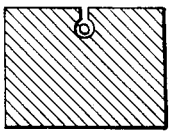

The assembly procedure for loading center or inner conductor 17 into the cylindrical cavity 19 of transmission line 1 will now be described with reference to FIGS. 12 and 13. At this time either female contact 25 or male pin 40 are assembled to inner conductor 17. A first group of dielectric support balls 49, 51, 53 are loaded inward of the right side of cylindrical cavity 19 using ball guide 73; then ball guide 73 is moved back to the right end, while the balls remain stationary. Three steel wires 75 (1/64 of an inch in diameter in this example) are inserted through holes in balls 80 at the left side of cavity 19. A second group of three balls 82 are loaded in the right side of cavity 19 using ball guide 73 while a first group of balls 80 are restricted from rolling via the steel wires 75. Propanol is used to reduce friction between the support balls 49, 51, 53 in groups 80, 82, and walls of cavity 19 to improve slippage. The outer guide tool 74 is tapered to gradually force the support balls 49, 51, 53 into compression. After both groups 80, 82 of balls 49, 51, 53 are loaded into cavity 19 with the center or inner conductor 17 protruding from the left side of end plate 7, female contact of connector assembly 11 is threaded onto inner conductor 17. A pin vise 84 is used to prevent inner conductor 17 from spinning, during mating of conductor 17 to contact assembly 11. Next, coupling nut 72, located on left end plate 7 is threaded onto the rear of female connector assembly 11 (see FIG. 1). A male or female shell 23, 25 (see FIG. 11) is attached to end plate 9 to complete assembly. In this example, a female connector shell 23 is used because a female contact 25 was used.

The various dimensions given in this example were established via laboratory experimentation. As shown in FIG. 3, recesses 43, 45, and 47 are provided for "locking in" or seating two groups of three dielectric balls 49, 51, 53, respectively, to support the inner conductor 17 centrally located within the outer conductor 9 (also see FIG. 9). The two groups of dielectric balls 49, 51, 53 were spaced about 2.90 inches apart, in this example. Good performance and a relatively low SWR was measured in using the subject invention for the support structure of the slotted transmission line 1 over a frequency range from 2 to 40 GHz. Also, the dielectric balls 49, 51 and 53 were found to offer excellent support for the center or inner conductor 17. Also, as previously mentioned, it is believed that the use of a dielectric ball support structure in conjunction with compensating V-grooves on either side of the dielectric balls will be useful for a broad range of coaxial transmission lines, and is not limited for use in slotted coaxial transmission lines. Other uses for the support structure and connector assembly of the present invention may occur to those of skill in the art, which uses may fall within the spirit and scope of the appended claims.

It will be understood that various changes in the details, materials, arrangements of parts and operating conditions which have been herein described and illustrated in order to explain the nature of the invention may be made by those skilled in the art within the principles and scope of the instant invention.

I claim:

1. A support structure for a coaxial transmission line comprises:

an elongated rigid outer conductor having a substantially hollow and cylindrical interior cavity portion about a longitudinal axis, said outer conductor having an inner surface;

an elongated substantially rigid cylindrical inner conductor centrally located within said outer conductor, having a longitudinal axis substantially parallel to said longitudinal axis of said outer conductor, said inner conductor having an outer surface;

a plurality of dielectric balls compressibly mounted between the inner and outer surfaces of said outer and inner conductors, respectively, said balls being evenly located about the circumference of said inner conductor, thereby providing support members for centrally retaining said inner conductor within said outer conductor;

retaining means for holding said dielectric balls in position, said retaining means including recesses in the outer surface of said inner conductor for receiving a portion of said balls; and standing wave compensation means for compensating for wave reflections caused by said balls, including;

holes bored through said balls, said balls being positioned for aligning the longitudinal axes of their holes with the longitudinal axis of said inner conductor, first V-grooves located contiguous to and on either side of each one of said recesses of said inner conductor, and being aligned with the longitudinal axis of said inner conductor, said V-grooves being dimensioned for maximizing the reduction of reflected waves between said inner and outer conductors.

2. The support structure of claim 1, further including;

first and second connector means for supporting the ends respectively, of said inner conductor coaxially with the longitudinal axis of said cavity, and providing electrical connection to said transmission line.

3. The support structure of claim 2, wherein said first and second connector means each include:

a male connector pin means rigidly attached to an end of said inner conductor;

means for providing an outer shell for said male connector; dielectric means located within said shell for electrically isolating and centrally retaining said connector pin means within said outer shell means.

4. The support structure of claim 2, wherein said first and said second connector means each include:

a female connector pin means rigidly attached to an end of said inner conductor;

means for providing an outer shell for said female connector; and dielectric means located within said shell for electrically isolating and centrally retaining said connector pin means within said outer shell means.

5. The support structure of claim 1, wherein said inner conductor consists of molybdenum material.

6. The support structure of claim 5, wherein said molybdenum inner conductor has a finish of less than 16 microinches RMS.

7. The support structure of claim 1, wherein said dielectric balls are arranged in a plurality of spaced apart groups, each group comprised of at least three of said balls, the balls of each group being spaced apart from other groups along the length of the outer surface of said inner conductor, the balls of each group being equally spaced from one another circumferentially about the outer surface of said inner conductor.

8. The support structure of claim 7, wherein, the balls of each group are spaced longitudinally along a transmission line with inter-ball spacing lesser than intergroup spacing.

9. The support structure of claim 7, wherein the balls within each of said groups are longitudinally displaced from one another.

10. The support structure of claim 1, wherein said V-grooves each are formed from 70 degree $\alpha$ conical recesses in the outer surface of said inner conductor.

11. The support structure of claim 1, wherein said V-grooves are engraved into the outer surface of said inner conductor.

12. The support structure of claim 1, wherein said recesses for retaining said dielectric balls in position are formed from second V-grooves cut into the outer surface of said inner conductor.

13. The support structure of claim 1, wherein said recesses for retaining said dielectric balls are formed from conical holes extending from the outer surface of said inner conductor to a predetermined depth within said inner conductor.

14. A support structure for an elongated coaxial transmission line comprises:

an elongated substantially rigid inner conductor located within a cavity of an outer conductor, said inner conductor having an outer surface and a longitudinal axis parallel with said elongated coaxial line; and a plurality of dielectric balls compressibly mounted between said inner and outer conductors, for both supporting and centrally retaining said inner conductor within said cavity; wherein each one of said dielectric balls is longitudinally displaced along the length of said inner conductor from other ones of said dielectric balls.

15. The support structure of claim 14, wherein said dielectric balls are locked in position about said inner conductor via recesses fabricated into the outer surface of said inner conductor at predetermined locations.

16. The support structure of claim 14, wherein said dielectric balls are comprised of a material selected from the group consisting of Teflon and Rexolite.

17. The support structure of claim 14, wherein said dielectric balls are arranged in a plurality of spaced-apart groups, each groups comprised of at least three of said balls, the balls of each group being equally spaced about the circumference of said inner conductor.

18. The support structure of claim 14, wherein said inner conductor consists of molybdenum having a surface finish of less than 16 microinch RMS.

19. A support structure for an elongated coaxial transmission line comprising:

elongated substantially rigid inner conductor located within a cavity of an outer conductor, said inner conductor having an outer surface and a longitudinal axis extending parallel with said elongated coaxial line, and a plurality of dielectric balls compressibly mounted between said inner and outer conductors, for both supporting and centrally-retaining said inner conductor within said cavity, wherein a compensation hole is bored through each one of said dielectric balls, and the longitudinal axis of the holes are aligned with the longitudinal axis of said inner conductor, thereby reducing the compressive fatigue upon said balls and minimizing the standing wave ratio of said coaxial transmission line.

20. A support structure for an elongated coaxial transmission line comprising:

elongated substantially rigid inner conductor located within a cavity of an outer conductor, said inner conductor having an outer surface and a longitudinal axis extending parallel with said elongated coaxial line, and a plurality of dielectric balls compressibly mounted between said inner and outer conductors, for both supporting and centrally-retaining said inner conductor within said cavity, wherein said dielectric balls are locked in position about said inner conductor via recesses fabricated into the outer surface of said inner conductor at predetermined locations, further including compensation means contiguous with said recesses for minimizing the standing wave ratio of said coaxial transmission line by reducing reflected waves caused by the presence of said dielectric balls.

21. The support structure of claim 20, wherein said compensation means includes first V-grooves cut into the outer surface of said inner conductor on either side of said recesses, said first V-grooves being aligned parallel with the longitudinal axis of said inner conductor.

22. The support structure of claim 21, wherein said recesses are formed from second V-grooves cut into the outer surface of said inner conductor and aligned parallel to said first V-grooves on either side of said recesses.

* * * * *